US005747709A

United States Patent [19]

Oshikubo

[11] Patent Number: 5,747,709

[45] Date of Patent: May 5, 1998

[54] REPETITIVE PIPETTE

[75] Inventor: Yuuji Oshikubo, Tokyo, Japan

[73] Assignee: Nichiryo Co., Ltd., Tokyo, Japan

[21] Appl. No.: 714,698

[22] Filed: Sep. 16, 1996

[30] Foreign Application Priority Data

Mar. 7, 1996 [JP] Japan ..... 8-050491

[51] Int. Cl.[6] ..... B01L 3/02

[52] U.S. Cl. ..... 73/864.18; 73/864.16; 222/287; 222/309; 222/391; 422/100; 422/928

[58] Field of Search ..... 222/43, 309, 391, 222/287; 73/864.16, 864.18; 422/100, 928

[56] References Cited

U.S. PATENT DOCUMENTS

| | | | |
|---|---|---|---|
| 4,099,548 | 7/1978 | Sturm et al. | 222/391 X |
| 4,406,170 | 9/1983 | Kuhn | 73/864.18 X |
| 4,467,942 | 8/1984 | Oshikubo | 222/309 X |
| 4,470,317 | 9/1984 | Sabloewski et al. | 73/864.16 |
| 4,591,072 | 5/1986 | Oshikubo | 222/309 X |
| 5,330,721 | 7/1994 | Tervamaki | 422/100 |
| 5,573,729 | 11/1996 | Belgardt | 222/309 X |
| 5,591,408 | 1/1997 | Belgardt et al. | 73/864.18 X |

FOREIGN PATENT DOCUMENTS 2147345 10/1995 Canada .

*Primary Examiner*—Kevin P. Shaver

*Attorney, Agent, or Firm*—Wenderoth, Lind & Ponack

[57] ABSTRACT

A repetitive pipette wherein a rack shaft (23) vertically and movably provided in a pipette body (1) is connected to a plunger (43) of a syringe unit (41), and a vertically movable and pivotable pawl member (16) repetitively moves downward and meshes with the rack shaft (23) to feed the plunger (43) downward by a predetermined feed pitch at each time, thereby effecting repetitive pipetting, and wherein the predetermined feed pitch for the rack shaft (23) can be variably set by a pipetted quantity variably setting device. A vertically movable push button (2) is provided on the pipette body (1). A rotary control knob (3) for variably setting a pipetted quantity is provided in coaxial relation to the push button (2) so as to be vertically movable together with the push button (2) as one unit and rotatable relative to the push button (2). A pawl retaining member (12) for retaining the pawl member (16) is vertically movable together with the push button (2) as one unit. A spring (13) upwardly biases the pawl retaining member (12), the push button (2), and the rotary control knob (3). A pawl stroke varying rotary cam (17) has a plurality of first cam step portions (17.1 to 17.5) for variably setting a position from which the pawl member (16) starts pivoting toward the rack shaft (23) to mesh with it. The rotary cam (17) is rotated together with the rotary control knob (3) as one unit to allow one of the first cam step portions to correspond to the pawl member (16) selectively. The pipetted quantity variably setting device includes the rotary control knob (3) and the pawl stroke varying rotary cam (17).

6 Claims, 18 Drawing Sheets

8
9
10a
10
10c
10c
10b
3a
3
4a
4a
4
2c
2
2b
2a
7
6
11
5
15
12
12a
14
16
13
17
17.4
17.5
22
18
1
1a
1d
24
29
23
1c
19a
19
20
21
30
31
33
32
27
26a
25
26
26c
26f
26h
43a
42a
42
41
28a
28b
28

REPETITIVE PIPETTE

BACKGROUND OF THE INVENTION

1. Field of the Invention

The present invention relates to repetitive pipettes. More particularly, the present invention relates to a repetitive pipette which is capable of pipetting a liquid sucked by a piston in quantities each corresponding to a predetermined feed pitch, and in which the feed pitch can be variably set.

2. Related Background Art

Japanese Patent Unexamined Publication (KOKAI) No. 56-7649 discloses a first type of conventional repetitive pipette capable of pipetting a liquid in predetermined quantities. According to the first type of conventional repetitive pipette, a pawl 39 is repeatedly meshed with a rack 14 by a pivoting motion of a driving lever 37 provided on a side of the pipette body, thereby feeding the rack 14 downward. Further, a moving cover 46 is properly moved to variably set a feed pitch for the rack 14 by a rotary cam mechanism (48 and 49) provided in the upper part of the pipette body. At the lower limit position of the rack 14, a spring 41 for biasing the pawl 39 rides over a projection 52 of the rack 14 to allow the pawl 39 to escape from the rack teeth, thereby determining a lower limit position for the plunger.

A second type of conventional repetitive pipette is disclosed in Japanese Patent Unexamined Publication (KOKAI) No. 6-7688. According to the second type of conventional repetitive pipette, a pinion 16 is interposed between a pair of racks 5 and 13, and a striker (pawl) 8 is repeatedly meshed with the rack 5 by a pivoting motion of a driving handle (lever) 9 provided on a side of the pipette body, thereby feeding the rack 5 downward while feeding the rack 13 upward through the pinion 16. An adjusting rod 23 for varying the meshing position of the pawl 8 is properly moved to variably set a feed pitch for the rack 5 by an adjusting wheel (rotary cam mechanism) 25 provided in the upper part of the pipette body. At the lower limit position of the rack 5, a spring 17 for biasing the pawl 8 falls into an escape recess 18 in the rack 13, thereby allowing the pawl 8 to escape from the rack teeth, and thus determining a lower limit position of the plunger.

The conventional pipettes suffer, however, from the following disadvantages:

① In both the above-described conventional repetitive pipettes, movable mechanisms are separately disposed at two positions, that is, an axial position and a side position, as in the arrangement wherein the pivoting lever is disposed on a side of the pipette body, and the rack feed pitch varying cam mechanism is disposed in the upper part of the pipette body. Accordingly, the arrangement is complicated as a whole, and the pipette body must be formed in a two-part structure. Therefore, the number of constituent elements increases, and the assembling and disassembling operations are complicated and troublesome.

② In both the conventional repetitive pipettes, the lever, which projects sideward from the pipette body is repeatedly pivoted downward. Therefore, the finger performing the repetitive operation is likely to come off the lever sidewardly. Thus, the conventional repetitive pipettes suffer from an unstable operation and inferior controllability.

③ In both the conventional repetitive pipettes, when the rack feed pitch is to be changed, the thumb, which has been placed on the lever projecting sideward from the pipette body, must be moved through a relatively long distance as far as the top of the pipette body in order to rotate the cam mechanism by a manual operation. Accordingly, it is necessary to change the way in which the user holds the pipette. Moreover, because the number of feed pitch varying operations required is usually relatively large, the operation of the conventional repetitive pipettes is extremely troublesome.

④ In both the conventional repetitive pipettes, when the meshing position of the pawl member, at which the pawl member meshes with the rack, is to be changed in order to variably set a pipetted quantity, the pawl member contacts the rotary cam mechanism indirectly through an intermediate member (i.e., the moving cover 46 or the adjusting rod 23); therefore, the accuracy of the operation degrades correspondingly. In addition, the need of an intermediate member makes the arrangement correspondingly complicated.

⑤ In both the conventional repetitive pipettes, even when the rack feed pitch is to be variably set, the following operation takes place at all times at the lower limit position of the plunger: In the first conventional repetitive pipette, the spring 41 for the pawl 39 rides over the projection 52 of the rack 14 to cancel mesh of the pawl 39 with the rack teeth. In the second conventional repetitive pipette, the spring 17 for the pawl 8 engages in the escape recess 18 of the rack 13 to cancel mesh of the pawl 8 with the rack teeth. Accordingly, it is likely in either of the conventional repetitive pipettes that the pawl mesh cancel position and hence the plunger lower limit position will become unstable owing to erroneous elastic deformation of the spring, which is characteristic thereof. Therefore, the pipetted quantity corresponding to the final feed pitch is likely to become inaccurate. Thus, the conventional repetitive pipettes lack reliability in operation.

OBJECTS OF THE INVENTION

An object of the present invention is to provide a repetitive pipette in which a push button and a pipetted quantity variably setting device are coaxially integrated into one unit, thereby making it possible to simplify the arrangement and the assembling and disassembling operations, and facilitating the pipetting operation.

Another object of the present invention is to provide a repetitive pipette in which a pawl member adapted to mesh with a rack shaft directly and selectively contacts one of a plurality of cam step portions of a pawl stroke varying rotary cam, thereby enabling an improvement in reliability of the operation.

SUMMARY OF THE INVENTION

To attain the above-described objects, the present invention provides a repetitive pipette wherein a rack shaft 23 vertically and movably provided in a pipette body 1 is connected to a plunger 43 of a syringe unit 41, and a vertically movable and pivotable pawl member 16 repetitively moves downward and meshes with the rack shaft 23 to feed the plunger 43 downward by a predetermined feed pitch at each time, thereby effecting repetitive pipetting, and wherein the predetermined feed pitch for the rack shaft 23 can be variably set by a pipetted quantity variably setting device. The repetitive pipette includes a vertically movable push button 2 provided on the pipette body 1. A rotary control knob 3 for variably setting a pipetted quantity is provided in coaxial relation to the push button 2 so as to be vertically movable together with the push button 2 as one unit and rotatable relative to the push button 2. A pawl retaining member 12 for retaining the pawl member 16 is vertically movable together with the push button 2 as one unit. A spring 13 upwardly biases the pawl retaining member 12, the push button 2, and the rotary control knob 3. A pawl stroke varying rotary cam 17 has a plurality of first cam step portions 17.1 to 17.5 for variably setting a position from which the pawl member 16 starts pivoting toward the rack shaft 23 to mesh with it. The pawl stroke varying rotary cam 17 is rotated together with the rotary control knob 3 as one unit to allow one of the first cam step portions to correspond to the pawl member 16 selectively. The pipetted quantity variably setting device includes the rotary control knob 3 and the pawl stroke varying rotary cam 17.

In the repetitive pipette, the rotary control knob 3 and the pawl stroke varying rotary cam 17 are preferably mounted on a shaft 22 so as to be rotatable together with the shaft 22 as one unit. The shaft 22 is rotatably mounted to the pipette body 1 in an axially fixed position.

In the repetitive pipette, the push button 2 is preferably provided with a ball 7 which selectively and biasedly engages with one of recesses 4*a* provided at circumferentially and equally spaced positions on the rotary control knob 3 or a member 4 which rotates together with the rotary control knob 3 as one unit, thereby click-positioning the rotary control knob 3 in the direction of rotation.

In addition, the present invention provides a repetitive pipette wherein a rack shaft 23 vertically and movably provided in a pipette body 1 is connected to a plunger holder 26 for holding a plunger 43 of a syringe unit 41, and a vertically movable and pivotable pawl member 16 repetitively moves downward and meshes with the rack shaft 23 to feed the plunger 43 downward by a predetermined feed pitch at each time, thereby effecting repetitive pipetting, and wherein the predetermined feed pitch for the rack shaft 23 can be variably set by a pipetted quantity variably setting device. The repetitive pipette includes a vertically movable push button 2 provided on the pipette body 1. A rotary control knob 3 for variably setting a pipetted quantity is provided in coaxial relation to the push button 2 so as to be vertically movable together with the push button 2 as one unit and rotatable relative to the push button 2. A pawl retaining member 12 for retaining the pawl member 16 is vertically movable by being pushed by the push button 2. A spring 13 upwardly biases the pawl retaining member 12, the push button 2, and the rotary control knob 3. A pawl stroke varying rotary cam 17 has a plurality of first cam step portions 17.1 to 17.5 for variably setting a position from which the pawl member 16 starts pivoting toward the rack shaft 23 to mesh with it. The pawl stroke varying rotary cam 17 is rotated together with the rotary control knob 3 as one unit to allow one of the first cam step portions to correspond to the pawl member 16 selectively. A suction stroke varying rotary cam 19 has a plurality of second cam step portions 19.1 to 19.5 for variably setting a suction stroke for the plunger 42 in order to settle a remainder of the number of teeth of the rack shaft 23. The suction stroke varying rotary cam 19 is rotated together with the rotary control knob 3 as one unit to allow one of the second cam step portions to correspond to a stopper portion 26*a* of the plunger holder 26 selectively. The pipetted quantity variably setting device includes the rotary control knob 3 and the pawl stroke varying rotary cam 17.

PREFERRED EMBODIMENTS

One embodiment of the repetitive pipette according to the present invention will be described below in detail with reference to the accompanying drawings. It should, however, be noted that the present invention is not necessarily limited to the following embodiment.

Figure 1:
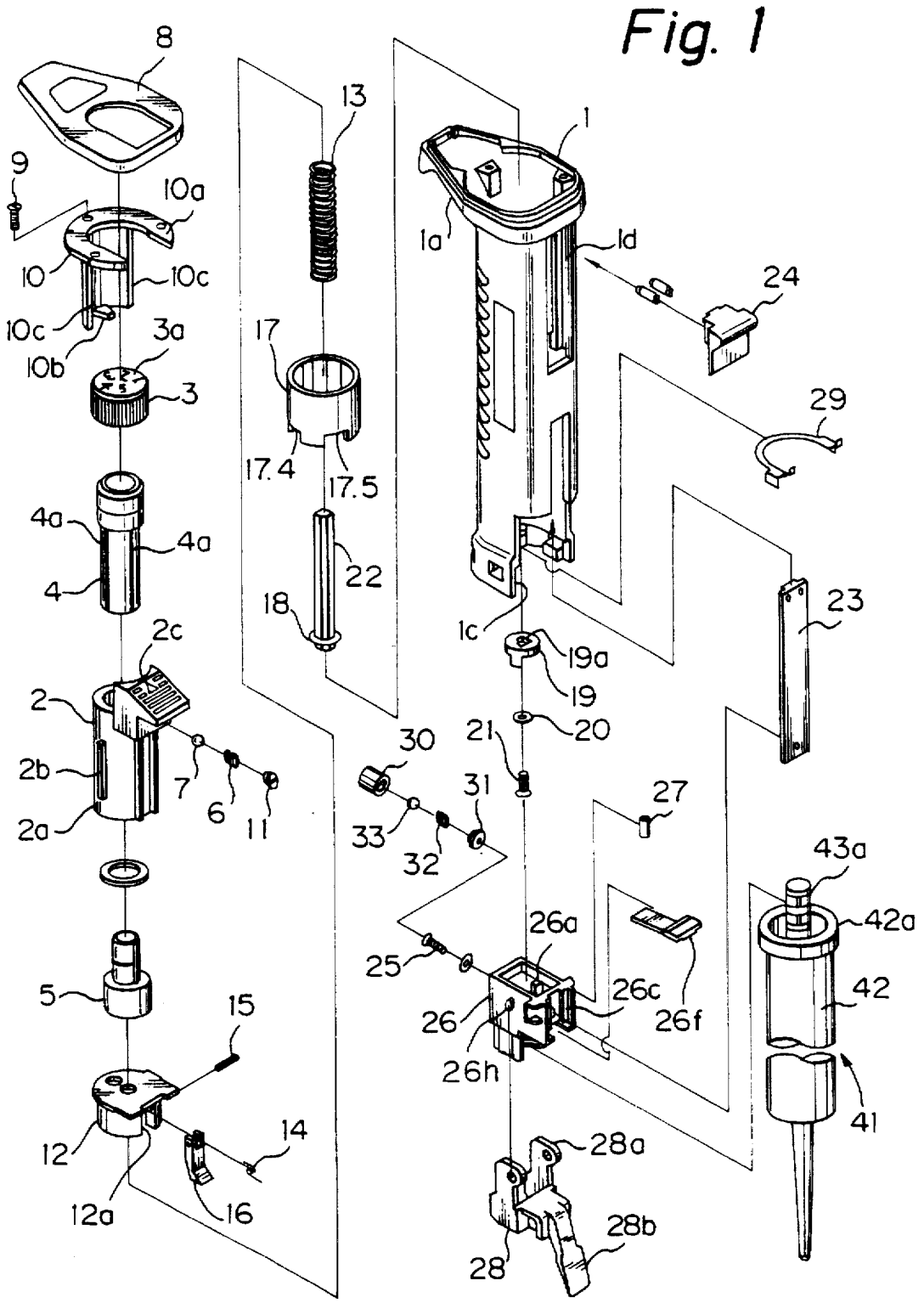
FIG. 1 is an exploded perspective view of one embodiment of the repetitive pipette according to the present invention.

FIG. 1 is an exploded perspective view of a repetitive pipette according to the present invention.

Figure 5:
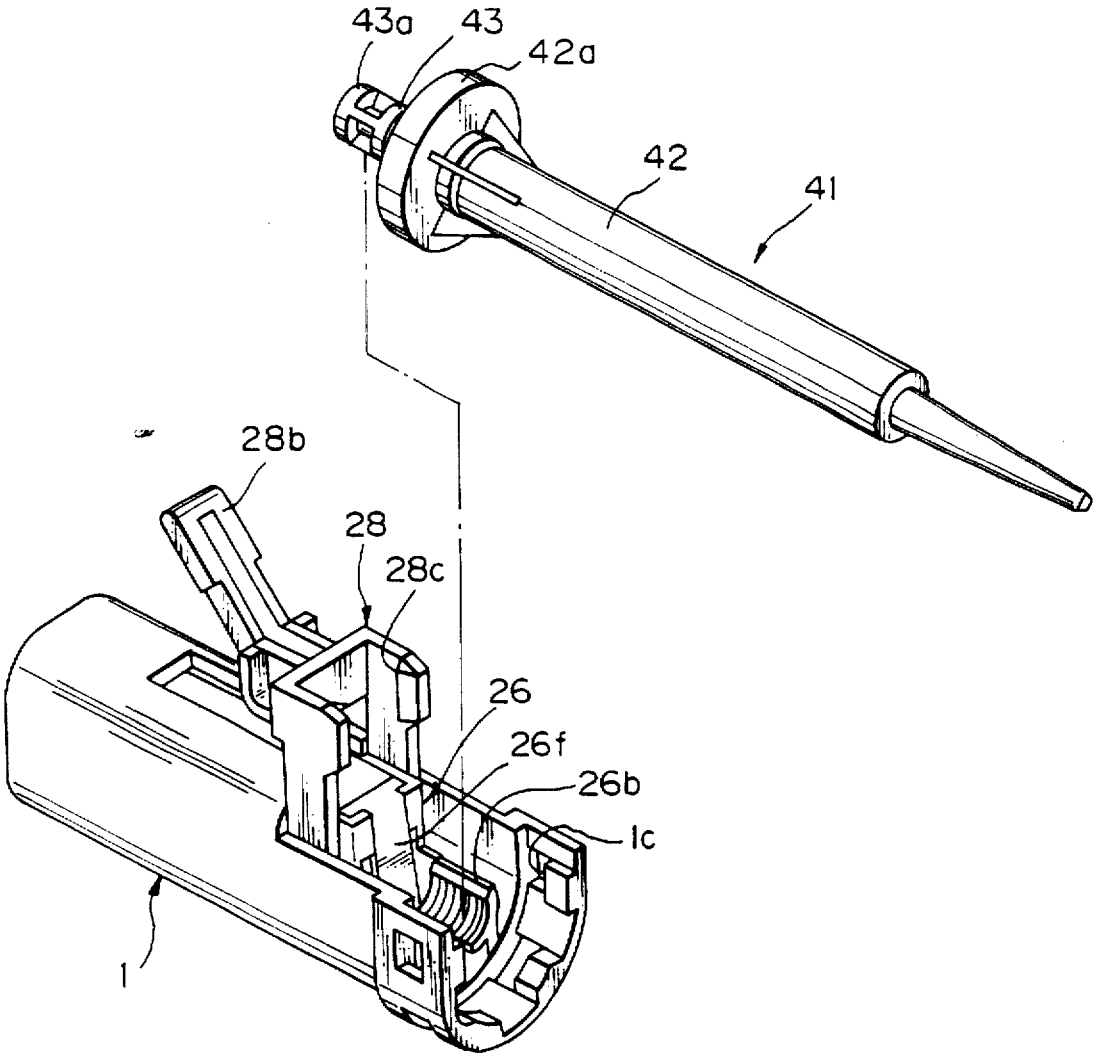
FIG. 5 is a perspective view showing the way in which a syringe unit is mounted in the repetitive pipette shown in FIG. 1.
Figure 8:
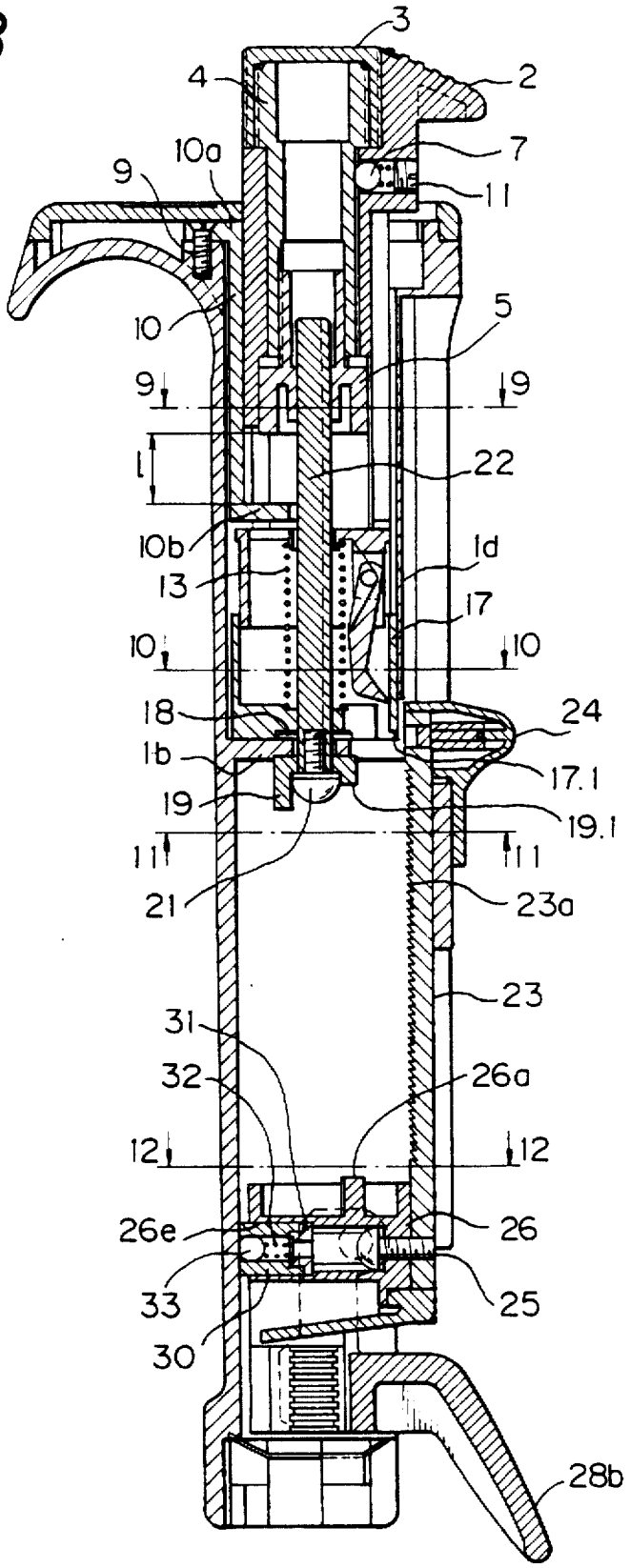
FIG. 8 is an enlarged sectional view illustrating the repetitive pipette shown in FIG. 1 in a state where a rack shaft has reached a lower limit position.

A pipette body 1 is formed in an approximately cylindrical shape by an integral molding process using a resin material. The pipette body 1 has a finger hook la at the upper end thereof, and an intermediate step portion 1*b* (see FIGS. 6 and 8) provided at an approximately middle thereof. The pipette body 1 further has a U-shaped recess 1*c* (see FIG. 5) provided in the lower end thereof, and a guide groove 1*d* (see FIGS. 3 and 8) provided in a side thereof. As shown in FIGS. 1 and 8, a stopper sleeve 10, which is, for example, a zinc die casting, is fitted to the upper end of the pipette body 1 and secured at a collar portion 10*a* thereof by setscrews 9. The stopper sleeve 10 further has a tongue-shaped stopper portion 10*b* at the lower end thereof, and a pair of guide portions 10*c* at an intermediate part thereof.

Figure 2:
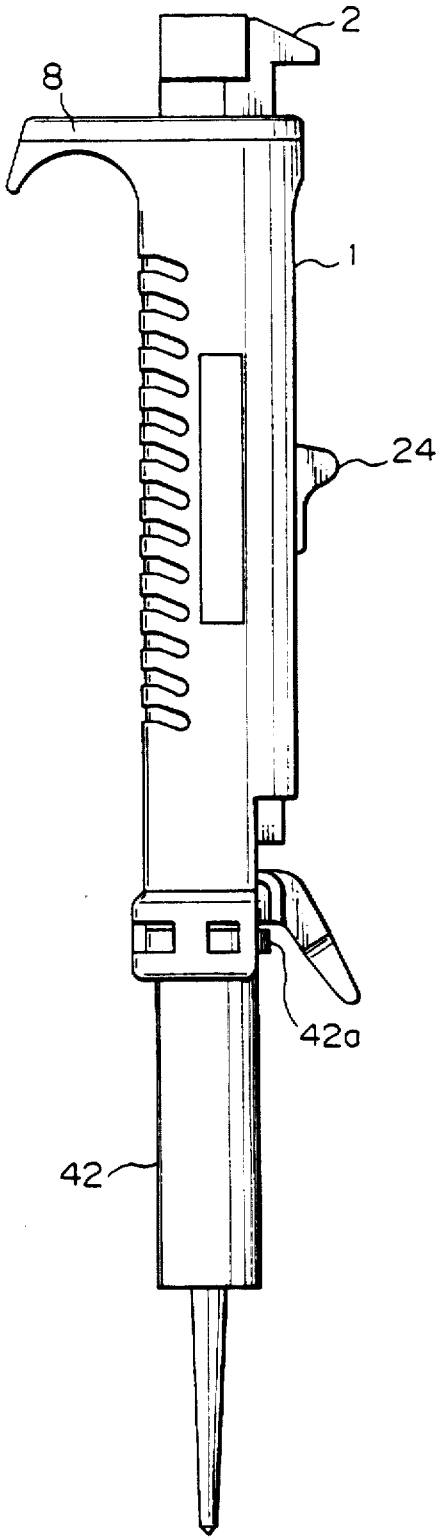
FIG. 2 is a side view of the repetitive pipette shown in FIG. 1.

As shown in FIG. 2, a push button 2 projects from the upper end of the pipette body 1, and a cap 8 covers the periphery of the push button 2.

A U-shaped leaf spring 29 (see FIG. 1) is fitted in the U-shaped recess 1*c* in the lower end of the pipette body 1. The U-shaped leaf spring 29 biases a collar portion 42*a* of a syringe 42 as engaged in the recess 1*c*, thereby stably retaining the syringe 42.

The push button 2 has a sleeve portion 2*a*. A rotary control knob 3 for variably setting a pipetted quantity, an intermediate sleeve 4 and a stopper ring 5 are assembled together as one unit, and as shown in FIG. 8, the assembly unit is incorporated into the sleeve portion 2*a* of the push button 2 such that the unit is rotatable relative to the sleeve portion 2*a*. The sleeve portion 2*a* is vertically movably fitted in the stopper sleeve 10 in the upper end portion of the pipette body 1. The push button 2 has a pair of elongated projections 2*b* on both sides thereof. The elongated projections 2*b* are guided by the respective guide portions 10*c* of the stopper sleeve 10. The push button 2 is biased upward by a spring 13, causing the upper end of each elongated projection 2*b* to abut on the lower surface of the collar portion 10*a*. A combination of a ball 7, a spring 6 and a setscrew 11 is incorporated into a hole in a side of the push button 2 to form a click mechanism for selectively setting rotational positions corresponding to variable pipetted quantity positions Nos. 1 to 5 of the rotary control knob 3. The top of the push button 2 is provided with a Δ mark 2*c* for correspondence to the numeral 3*a* of a selected one of the variable pipetted quantity positions Nos. 1 to 5 of the knob 3.

Figure 6:
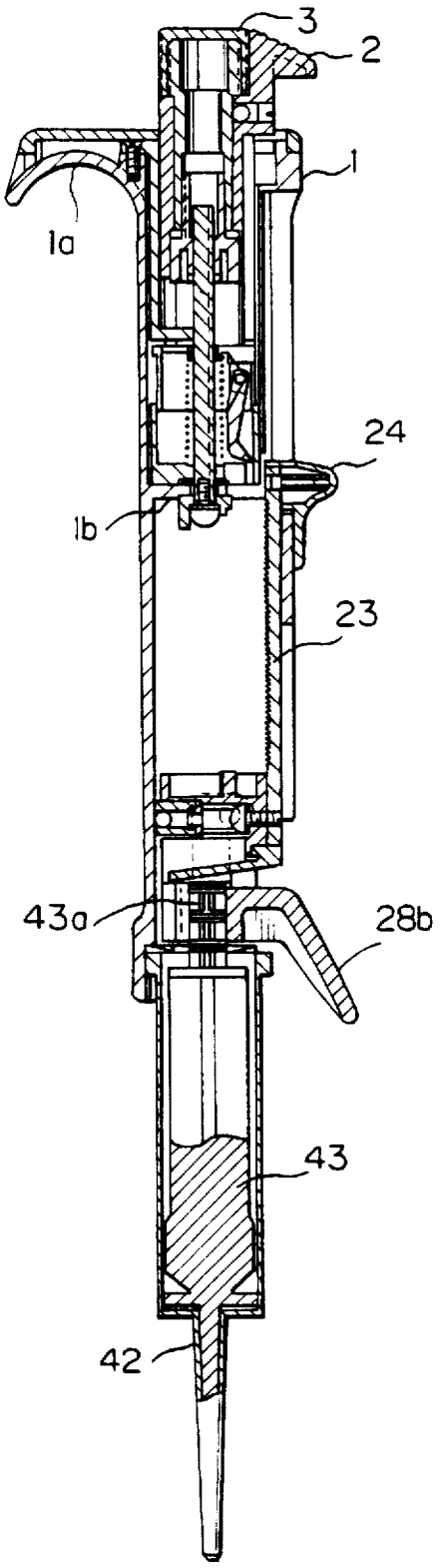
FIG. 6 is a longitudinal sectional view of the repetitive pipette shown in FIG. 1.

Accordingly, when pushed down with a finger against the spring 13, the push button 2 moves downward through a fixed stroke 1 (=8.5 mm; see FIG. 8) at all times, together with the assembly unit (3, 4 and 5), from the position shown in FIGS. 6 and 8 until the lower end of the stopper ring 5 comes in contact with the stopper portion 10*b* of the stopper sleeve 10. When released from the pressure, the push button 2 moves upward to return to the previous position. This operation is repeated for each pipetting operation.

The top of the rotary control knob 3 is marked with numerals 3*a* as Nos. 1 to 5 indicating variable pipetted quantities. The numerals 3*a* are circumferentially spaced at equal intervals. A pipetted quantity is selected by turning the rotary control knob 3 such that the selected numeral 3*a* coincides with the Δ mark 2*c*.

The intermediate sleeve 4 has five axial grooves 4*a* provided on its outer peripheral surface such that the grooves 4*a* are circumferentially spaced at equal intervals. The ball 7, which is being biased by the spring 6, selectively engages in one of the grooves 4*a*. As a result, click-stopped rotational position setting is effected. The rotary control knob 3 is press-fitted to the upper end of the intermediate sleeve 4 in a predetermined angle position through a keyway. The stopper ring 5 is press-fitted to the lower end of the intermediate sleeve 4 in a predetermined angle position through a keyway with an adjusting ring interposed therebetween. Thus, the intermediate sleeve 4, the rotary control knob 3 and the stopper ring 5 rotate together as one unit relative to the push button 2 and vertically move together with the push button 2 as one unit.

Figure 9:
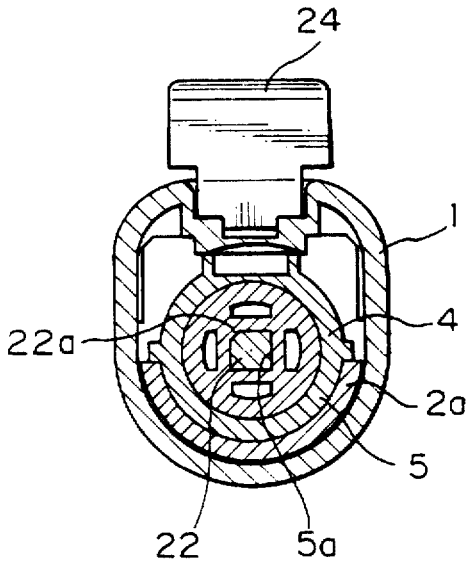
FIG. 9 is a sectional view taken along the line 9—9 in FIG. 8, illustrating the repetitive pipette shown in FIG. 1.

As shown in FIG. 9, the stopper ring 5 has a square hole 5*a* in its center for passing a rotating shaft 22. The square hole 5*a* has a fillet in only one corner thereof.

Figure 13:
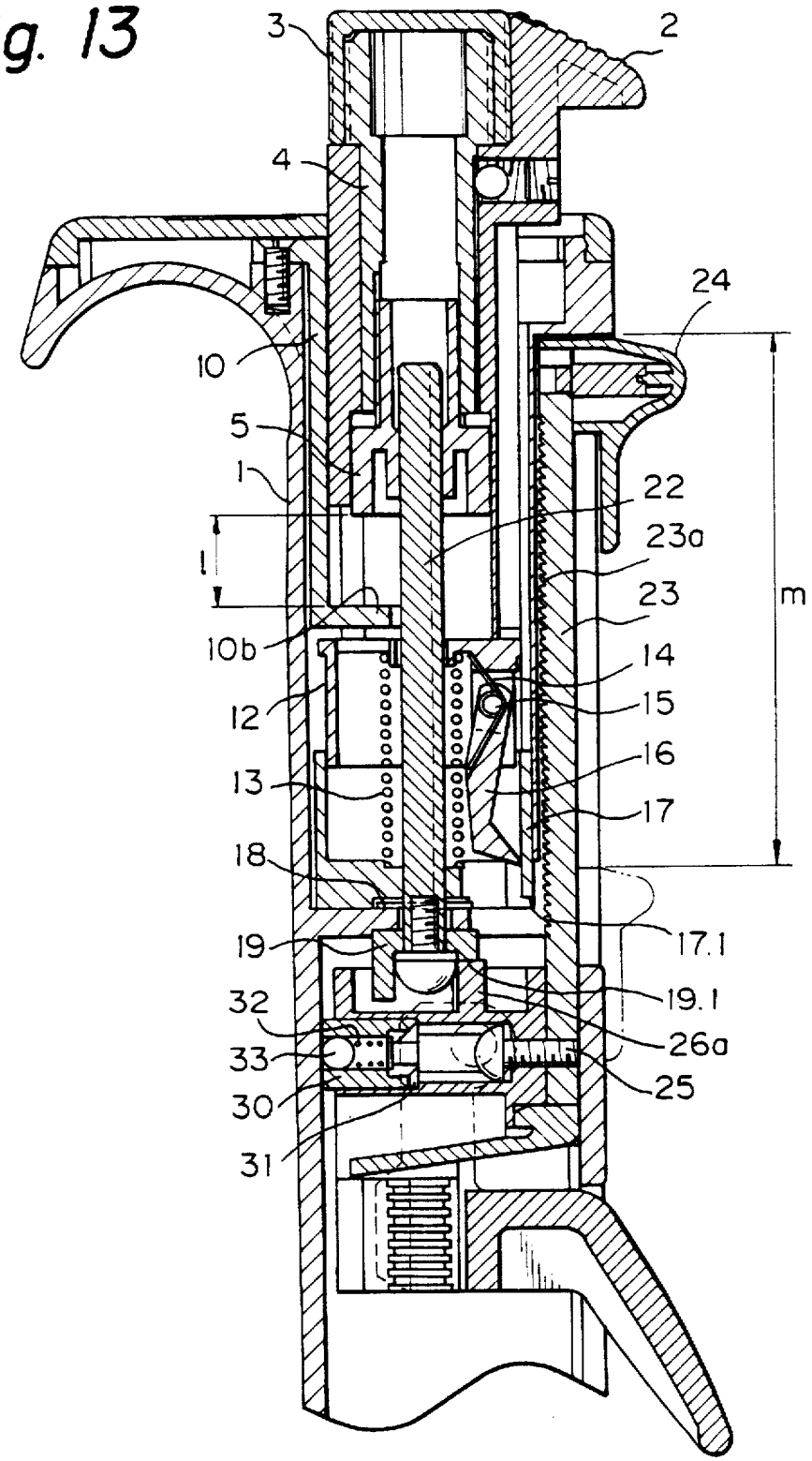
FIG. 13 is an enlarged sectional view illustrating the repetitive pipette shown in FIG. 1 in a state where a liquid has been sucked with the rotary control knob position No. 1 selected.
Figure 14:
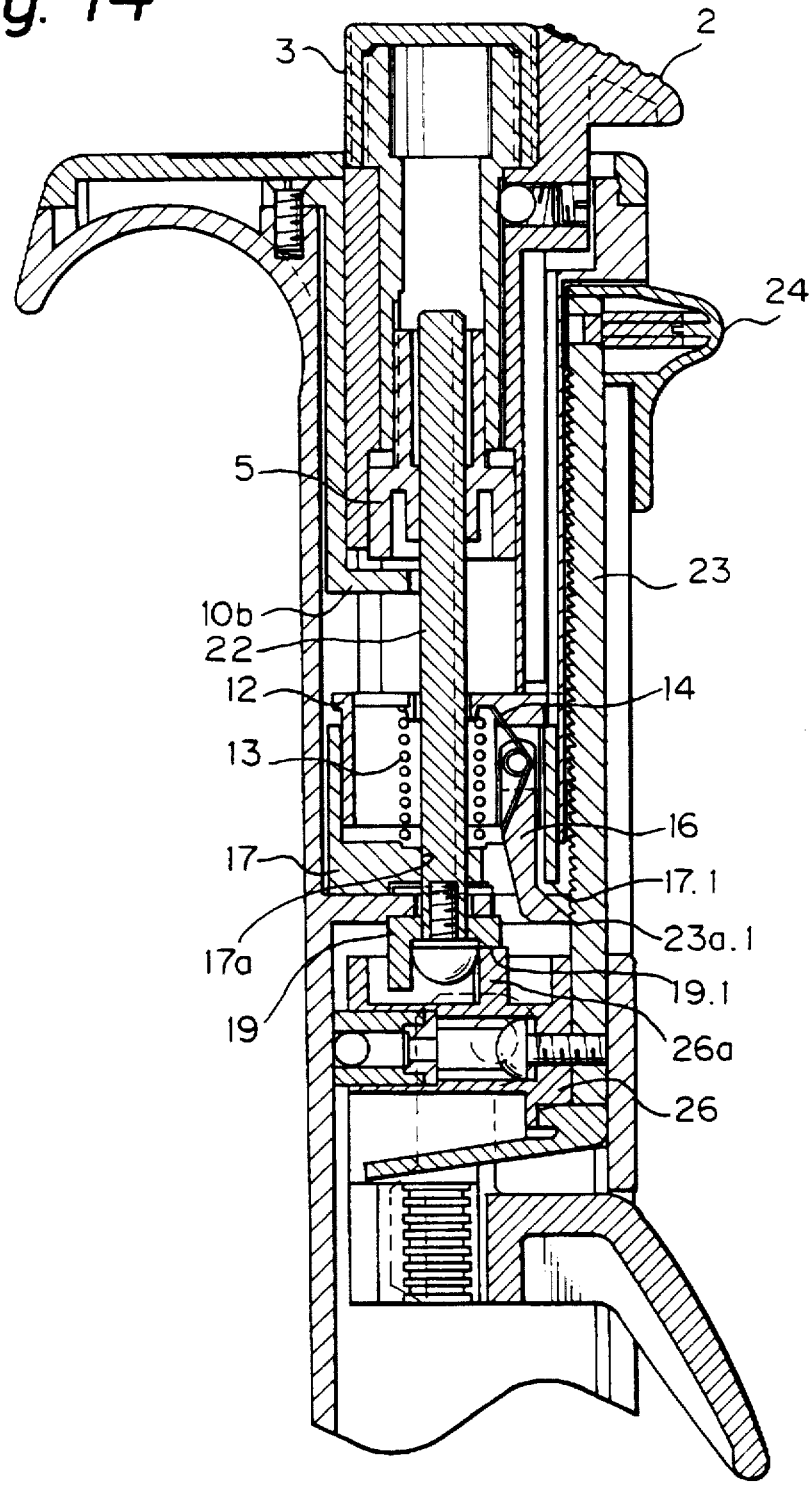
FIG. 14 is an enlarged sectional view illustrating the repetitive pipette shown in FIG. 1 in a state where a pawl has been meshed with the rack shaft after a liquid has been sucked with the rotary control knob position No. 1 selected.

As shown in FIG. 13, a pawl retaining sleeve 12 is biased upward by the spring 13 so as to abut on the lower end of the push button 2. Accordingly, when the push button 2 is pushed down, the pawl retaining sleeve 12 moves downward together with the push button 2 as one unit through the same stroke 1 (=8.5 mm) as that of the push button 2. A pawl 16 is mounted through a pin 15 in a slit 12*a* (see FIG. 1) provided in a side of the pawl retaining sleeve 12. The pawl 16 is biased by a spring 14 to rotate such that the distal end of the pawl 16 projects outward. The lower end portion of the pawl retaining sleeve 12 is vertically movably inserted into a pawl stroke varying rotary cam 17. Accordingly, in the pawl stroke varying rotary cam 17, the pawl 16 has its distal end abutting on the inner wall of the rotary cam 17, as shown in FIG. 13. However, when the push button 2 is pushed down, the pawl 16 moves downward and projects through one of cam recesses 17.1 to 17.5 in the pawl stroke varying rotary cam 17 by the action of the spring 14, and engages with a tooth of a rack shaft 23, as shown in FIG. 14. When the push button 2 is further pushed down from the position shown in FIG. 14 through a distance corresponding to the remaining stroke until the stopper ring 5 comes in contact with the stopper portion 10*b*, the pawl 16 causes the rack shaft 23 to move downward through a distance corresponding to the remaining stroke, that is, one feed pitch of the rack shaft 23. It should be noted that a center hole of the pawl retaining sleeve 12 has a diameter larger than the outer diameter of the rotating shaft 22. Therefore, the pawl retaining sleeve 12 is capable of only vertical movement, and it is non-rotatable.

The spring 13 is interposed between the pawl retaining sleeve 12 and the pawl stroke varying rotary cam 17. The spring 13 constantly biases upwardly the pawl retaining sleeve 12 and the push button 2, which abuts on the pawl retaining sleeve 12, together with the members 3, 4 and 5, which are integrated with the push button 2. At the same time, the spring 13 biases the pawl stroke varying rotary cam 17 downward, causing the rotary cam 17 to abut on the intermediate step portion 1*b* of the pipette body 1 at all times.

Figure 10:
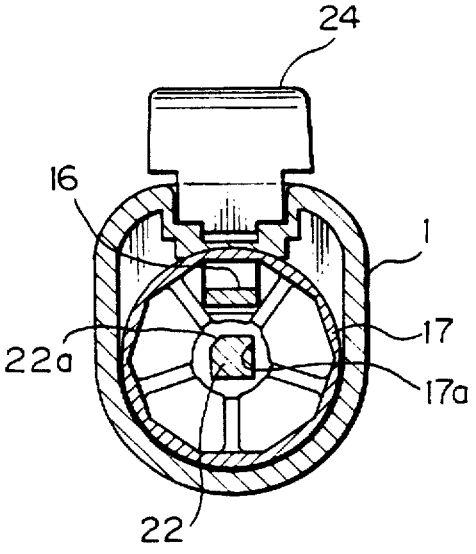
FIG. 10 is a sectional view taken along the line 10—10 in FIG. 8, illustrating the repetitive pipette shown in FIG. 1.

As shown in FIG. 8, the pawl stroke varying rotary cam 17 is rotatably inserted into the pipette body 1 so as to lie on the intermediate step portion 1*b*. The outer periphery of the rotary cam 17 is provided with five cam recesses 17.1 to 17.5 (see FIGS. 1 to 8) of different depths for varying the pawl stroke. The cam recesses 17.1 to 17.5 respectively correspond to the variable pipetted quantity positions Nos. 1 to 5 of the rotary control knob 3. More specifically, the cam recess 17.1 is provided at a circumferential position corresponding to the position No. 1 of the five numerals 3*a* marked on the rotary control knob 3. The depth of the cam recess 17.1 is set such that, as shown in FIG. 13, when a suction button 24 is pushed down through a stroke m, a projection-shaped stopper 26*a* of a plunger and rack holder 26 is brought into contact with a cam projection 19.1 of a suction stroke varying rotary stopper 19 (described later), and in this state, when the pawl 16 is allowed to project outward from the cam recess 17.1 of the rotary cam 17 by pushing down the push button 2, the pawl 16 meshes with the lowermost tooth 23*a*.1 [see FIG. 14 and part (*a*) of FIG. 20] of the rack shaft 23 having reached a pawl meshing reference height hO (described later). The other cam recesses 17.2 to 17.5 are provided at respective circumferential positions corresponding to the positions Nos. 2 to 5 of the rotary control knob 3. The depths of the cam recesses 17.2 to 17.5 are set as follows: Assuming that the height level of the cam recess 17.1 is zero, the cam recess 17.2 is recessed upward more than the cam recess 17.1 by +1 mm (equal to 1 tooth pitch). The cam recess 17.3 is recessed upward more than the cam recess 17.1 by +2 mm (equal to 2 tooth pitches). The cam recess 17.4 is recessed upward more than the cam recess 17.1 by +3 mm (equal to 3 tooth pitches). The cam recess 17.5 is recessed upward more than the cam recess 17.1 by +4 mm (equal to 4 tooth pitches). The center of the pawl stroke varying rotary cam 17 is provided with a square hole 17*a* for passing the rotating shaft 22. As shown in FIG. 10, the square hole 17*a* has a fillet in only one corner thereof as is the case with the square hole 5*a* of the stopper ring 5.

Figure 11:
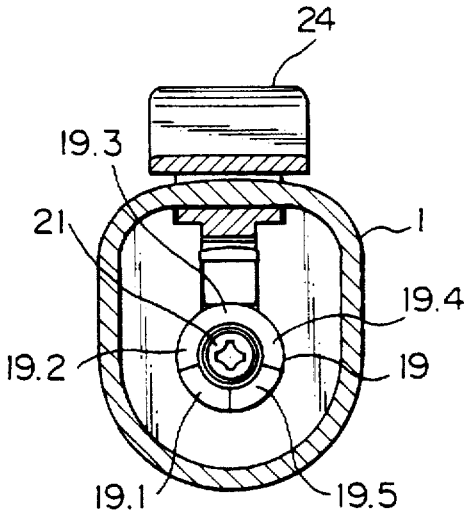
FIG. 11 is a sectional view taken along the line 11—11 in FIG. 8, illustrating the repetitive pipette shown in FIG. 1.

The suction stroke varying rotary stopper 19 is rotatably fitted to the lower surface of the intermediate step portion 1*b* in the pipette body 1 by a screw 21 through a washer 20. The lower end of the rotary stopper 19 is provided with five cam projections 19.1 to 19.5 of different heights for varying the suction stroke. The cam projections 19.1 to 19.5 respectively correspond to the variable pipetted quantity positions Nos. 1 to 5 of the rotary control knob 3. More specifically, as shown in FIG. 11, which shows the rotary stopper 19 as seen from the bottom thereof, the cam projections 19.1 to 19.5 are provided at respective circumferential positions corresponding to the variable pipetted quantity positions Nos. 1 to 5. In this case, however, the three cam projections 19.2 to 19.4 have the same height because the three variable pipetted quantity positions Nos. 2, 3 and 4 are equal to each other in terms of the number of teeth remaining when the rack shaft 23 is pushed down as far as the lowermost limit, that is, 1, as described later. The center of the rotary stopper 19 is provided with a square hole 19*a* (see FIG. 1) which has a fillet in only one corner thereof as is the case with the stopper ring 5 and the pawl stroke varying rotary cam 17.

The height of the cam projection 19.1 is determined in relation to the depth of the cam recess 17.1 of the rotary cam 17 as described above. That is, as shown in FIG. 13, when the projection-shaped stopper 26*a* of the plunger and rack holder 26 abuts on the cam projection 19.1, the lowermost tooth 23*a*.1 of the rack shaft 23 moves upward as far as the pawl meshing reference height hO [see part (*a*) of FIG. 20]. The cam projections 19.2 to 19.4 project downward more than the cam projection 19.1 by 1 mm (equal to 1 tooth pitch), and the cam projection 19.5 projects downward more than the cam projection 19.1 by 4 mm (equal to 4 tooth pitches). The reason why the cam projections 19.1 to 19.5 differ in height from each other is as follows: Regarding the total number of teeth 23*a* of the rack shaft 23 (in this case, 49 teeth, and the tooth pitch is 1 mm), the feed pitch per depression of the push button 2 is changed as being 1 to 5 by the pawl stroke varying rotary cam 17, and when the total number of teeth 23*a* of the rack shaft 23, that is, 49 teeth, is divided by the different feed pitches 1, 2, 3, 4, and 5, the numbers of remaining teeth (hereinafter referred to as "remainders") are 0, +1, +1, +1, and +4, respectively. Therefore, variations corresponding to the remainders are previously absorbed by the cam projections 19.1 to 19.5. More specifically, as shown in parts (*a*) to (*d*) of FIG. 20, the lowermost tooth 23*a*.1 is previously set at pitch height positions of 0, −1, −1, −1 and −4 relative to the pawl meshing reference height hO by the cam projections 19.1 to 19.5 corresponding to the variable pipetted quantity positions Nos. 1 to 5, thereby absorbing the above-described remainders such that these values are all canceled to be zero at the variable pipetted quantity positions Nos. 1 to 5.

The rotating shaft 22 has an E-ring 18 engaged therewith at a predetermined height position. The shaft 22 is rotatably inserted into a hole in the intermediate step portion 1*b* until the E-ring 18 comes in contact with the upper surface of the step portion 1*b*. The rotary cam 17, the spring 13, the pawl retaining sleeve 12 and the stopper ring 5 are successively fitted onto a portion of the rotating shaft 22 which is above the intermediate step portion 1*b*. The rotary stopper 19 is mounted on a portion of the rotating shaft 22 which is below the intermediate step portion 1*b*. The stopper ring 5 and the members 2, 3 and 4, which are integrated with the stopper ring 5, together with the pawl retaining sleeve 12, are vertically movable relative to the rotating shaft 22.

The rotating shaft 22 has a square cross-sectional configuration corresponding to the square holes in the stopper ring 5, the pawl stroke varying rotary cam 17 and the suction stroke varying rotary stopper 19, thus enabling unitary rotation of the stopper ring 5 and the members 3 and 4, which are integrated with the stopper ring 5, together with the rotary cam 17 and the rotary stopper 19. It should be noted that the pawl retaining sleeve 12, that is, the pawl 16, does not rotate together with the shaft 22 as one unit.

The rotating shaft 22 has a chamfer 22*a* (see FIGS. 9 and 10) provided in only one corner of the square cross-sectional configuration. The chamfer 22*a* can match only the fillet in one corder of each of the square holes 5*a*, 17*a* and 19*a* of the stopper ring 5, the rotary cam 17 and the rotary stopper 19. Accordingly, each of the members 3, 5, 22, 17 and 19 can assume only a predetermined angular position in the rotational direction. Thus, the variable pipetted quantity positions Nos. 1 to 5 in the rotational direction of the knob 3 and each of the members 17 and 19 are kept in a fixed angular positional relation to each other through the shaft 22 irrespective of assembling and disassembling operations.

Figure 3:
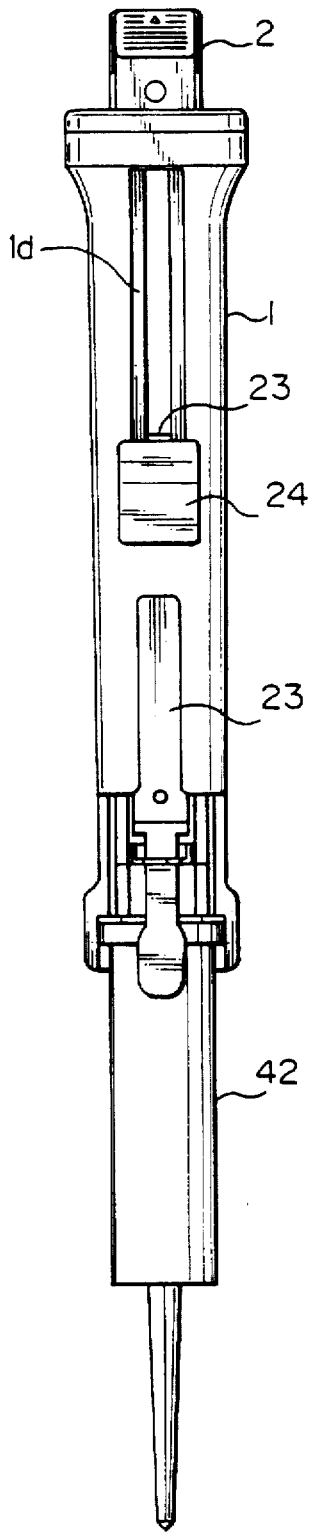
FIG. 3 is a front view of the repetitive pipette shown in FIG. 1.

The rack shaft 23 is produced by die casting of zinc. As shown in FIGS. 3 and 8, the rack shaft 23 is inserted into the guide groove 1*d* provided in a side of the pipette body 1. The rack shaft 23 has 49 teeth 23*a* formed on its inner side at a tooth pitch P (=1 mm). The plunger and rack holder 26 is mounted on the lower end of the rack shaft 23. The suction button 24 is rigidly secured to the upper end portion of the outer surface of the rack shaft 23 by using a pin. When the suction button 24 is pushed up, the rack shaft 23 moves upward, and the holder 26 and a plunger 43 held by it move upward together with the rack shaft 23 as one unit (see FIGS. 7 and 13).

Figure 4:
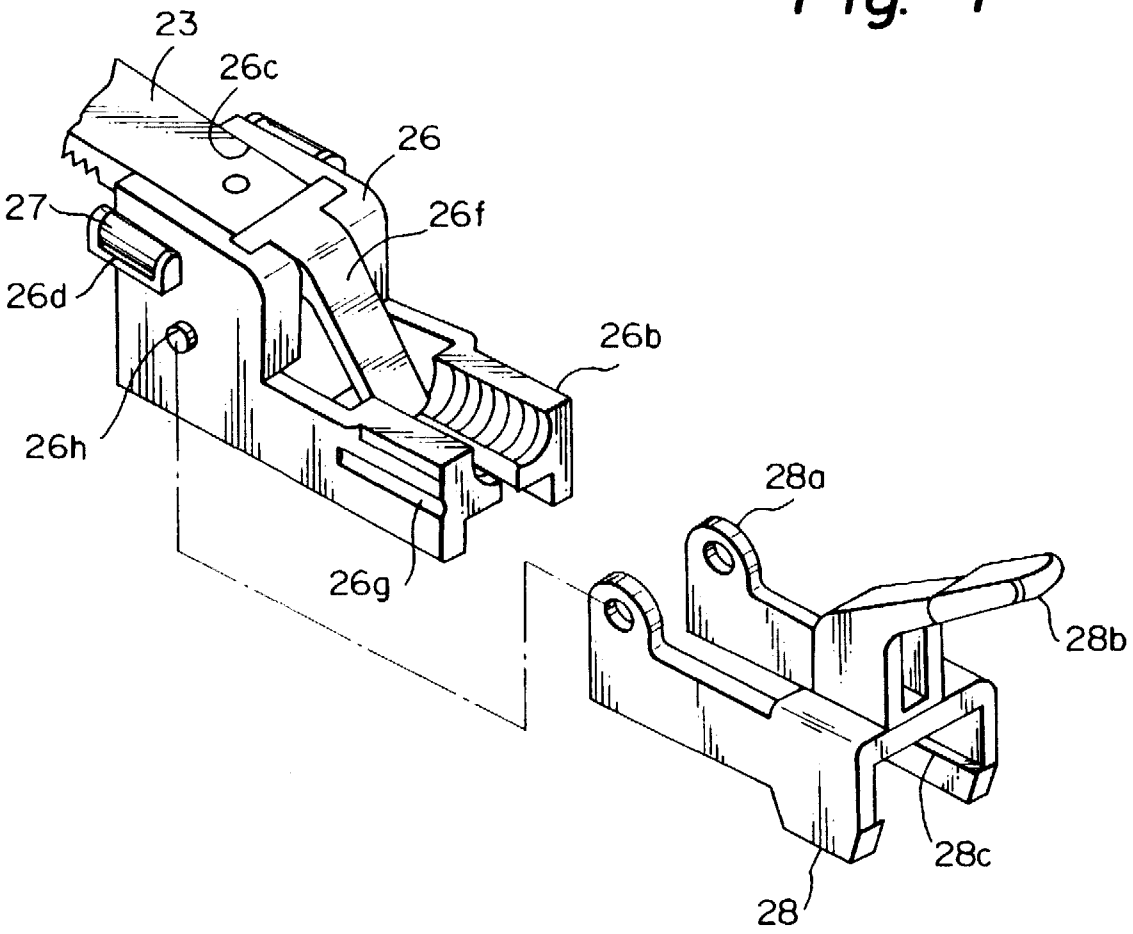
FIG. 4 is a perspective view of a plunger and rack holder and a lock handle in the repetitive pipette shown in FIG. 1.
Figure 12:
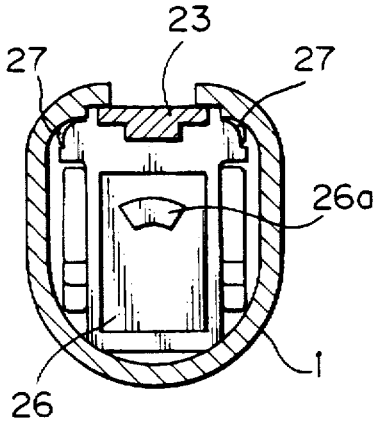
FIG. 12 is a sectional view taken along the line 12—12 in FIG. 8, illustrating the repetitive pipette shown in FIG. 1.

As shown in FIGS. 1 and 12, the plunger and rack holder 26 has a projection-shaped stopper 26*a* in the center of its top. The stopper 26*a* is adapted to abut on one of the cam projections 19.1 to 19.5 of the rotary stopper 19. As shown in FIG. 4, the holder 26 has a pair of chucking portions 26*b* supported in a cantilever fashion at the lower end thereof. The holder 26 further has a limiting plate member 26*f* attached thereto at a position above the chucking portions 26*b* to define an upper limit position for a plunger head 43*a* when set in the chucking portions 26*b*. The outer sides of the chucking portions 26*b* are provided with respective recesses 26*g* for engaging a lock handle 28. The rack-side surface of the holder 26 is provided with a groove 26*c* (see FIGS. 1 and 4) for mounting the rack shaft 23 by a setscrew 25. A pair of recesses 26d are provided at both sides, respectively, of the groove 26c to accommodate respective tension tubes 27 made of silicon for giving a moderate resistance to the motion of the rack shaft 23. As shown in FIG. 8, the inside of the holder 26 is provided with a hole 26e for mounting a ball 33. The ball 33 is accommodated in a ball casing 30 which is inserted in the hole 26e. The ball 33 is biased outward by a spring 32 which is interposed between the ball 33 and a ball cap casing 31, thereby enabling the holder 26 to move up and down smoothly. In addition, both sides of the holder 26 are provided with projections 26h (see FIG. 4) for mounting the lock handle 28. It should be noted that the tension tubes 27 may be coated with a lubricating oil.

As shown in FIG. 4, the lock handle 28 has a pair of arm portions 28a and a handle portion 28b. The arm portions 28a are pivotally supported by the pair of projections 26h of the holder 26 through a pair of holes provided in the arm portions 28a. The arm portions 28a have a pair of projections 28c which are respectively formed on the inner sides of their proximal end portions. Consequently, the lock handle 28 pivots when the handle portion 28b is pushed down. As a result, the projections 28c click into the recesses 26g, respectively, causing the pair of chucking portions 26b to be elastically deformed inward, thereby locking the head 43a of the plunger 43 in a syringe unit 41.

Next, a pipetting operation carried out by using the repetitive pipette according to the present invention will be explained with reference to the drawings. It should be noted that, in FIGS. 8 and 13 to 19, illustration of the syringe unit 41 is omitted for the sake of convenience.

First, the suction button 24 is pushed down, thereby causing both the rack shaft 23 and the holder 26 to move downward, as shown in FIGS. 6 and 8.

Next, the handle portion 28b of the lock handle 28 is raised to set the syringe unit 41. Thereafter, the syringe unit 41 is locked by lowering the handle portion 28b.

Next, the rotary control knob 3 is rotated such that the numeral No. 1 coincides with the Δ mark 2c, thereby allowing the intermediate sleeve 4, the stopper ring 5, the shaft 22, the pawl stroke varying rotary cam 17 and the suction stroke varying rotary stopper 19 to rotate together as one unit. Consequently, as shown in FIG. 8, the cam recess 17.1 of the rotary cam 17 moves as far as a position where it faces the rack shaft 23, and at the same time, the cam projection 19.1 of the rotary stopper 19 moves as far as a position which corresponds to the stopper 26a of the holder 26.

Figure 7:
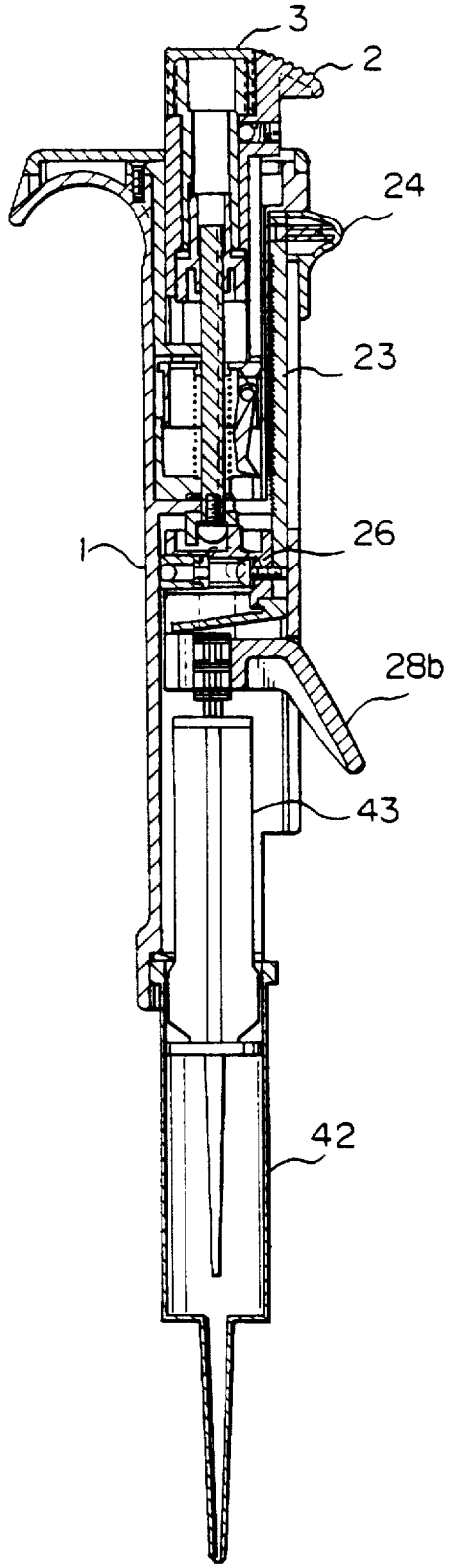
FIG. 7 is a longitudinal sectional view of the repetitive pipette shown in FIG. 1.

Next, the tip of the syringe 42 is put into a liquid, and the suction button 24 is pushed up until the stopper 26a of the holder 26 comes in contact with the cam projection 19.1 of the rotary stopper 19, as shown in FIGS. 7 and 13. Consequently, the rack shaft 23, the holder 26 and the plunger 43 are moved upward through the stroke m (corresponding to 49 tooth pitches of the rack shaft 23), and thus the syringe 42 is filled with a predetermined amount of liquid. At this time, as shown in FIG. 13 and part (*a*) of FIG. 20, the lowermost tooth 23a.1 of the rack shaft 23 lies at a height position where the pawl 16 projecting from the cam recess 17.1 of the rotary cam 17 first meshes with the rack shaft 23, that is, the pawl meshing reference height hO. In this case, the lower limit height h1 (see FIG. 20) of the pawl 16 when the pawl 16 moves downward to feed the rack shaft 23 downward has previously been set by the stroke l such that the lower limit height h1 is always lower than the pawl meshing reference height hO by 1 mm (corresponding to 1 tooth pitch).

Figure 15:
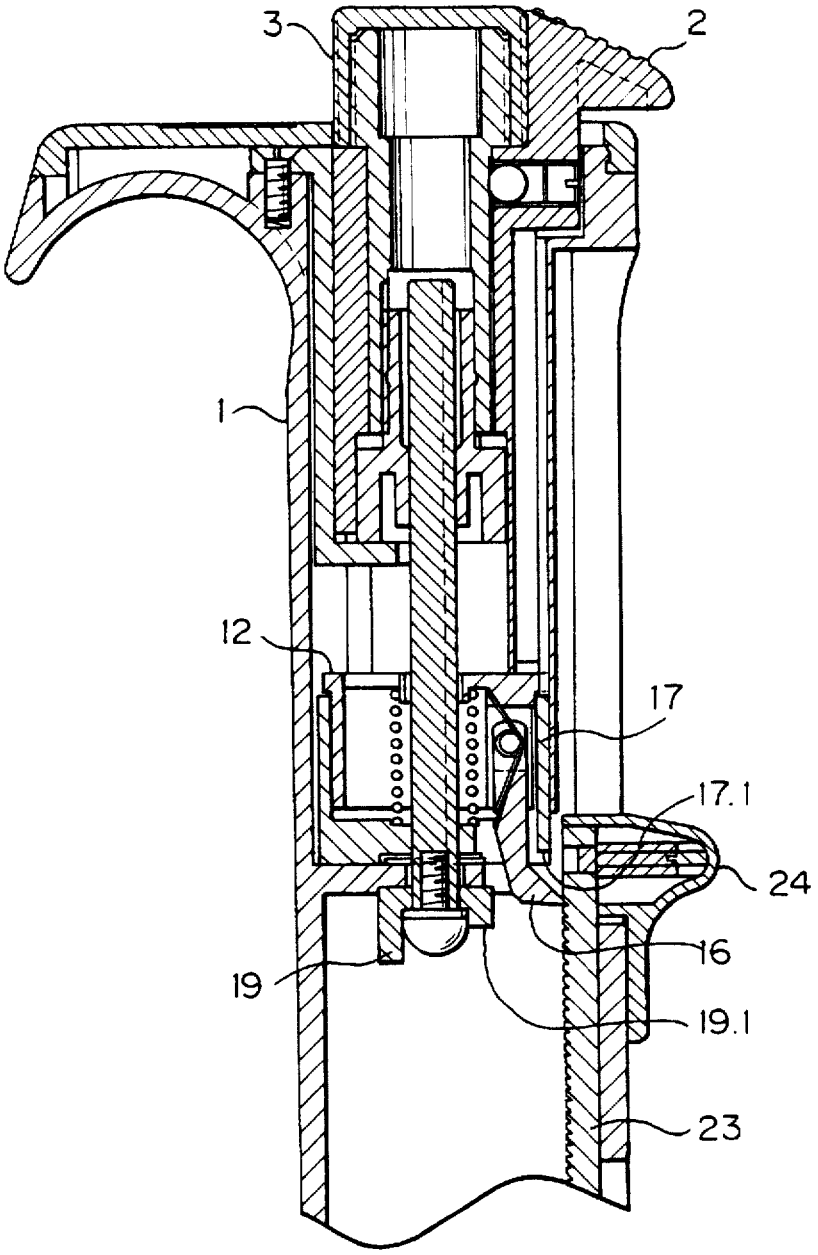
FIG. 15 is an enlarged sectional view illustrating the repetitive pipette shown in FIG. 1 in a state where a series of pipetting operations have been completed with the rotary control knob position No. 1 selected.

Next, the push button 2, together with the pawl retaining sleeve 12, is pushed down through the stroke l, causing the stopper ring 5 to come in contact with the stopper portion 10b of the stopper sleeve 10. Thus, the pawl 16, which has been held in the rotary cam 17, is allowed to project toward the rack shaft 23 from the cam recess 17.1, as shown in FIG. 14 and part (*a*) of FIG. 20. Consequently, the pawl 16 meshes with the lowermost tooth 23a.1 of the rack shaft 23 and pushes it down by one pitch to the lower limit height h1. When the push button 2 is released from the depression, the pawl retaining sleeve 12 is pushed back upward by the restitutive force of the spring 13, and the pawl 16 is put back in the rotary cam 17. The push button 2 and the members 3, 4 and 5, which are associated with it, also move upward together with the pawl retaining sleeve 12 as one unit, thus returning to the initial state. When this operation is subsequently repeated 48 times, that is, when the operation is carried out 49 times in total, the 49th tooth of the rack shaft 23 reaches the lower limit position, as shown in FIG. 15. Accordingly, in this case there is no remainder.

Figure 16:
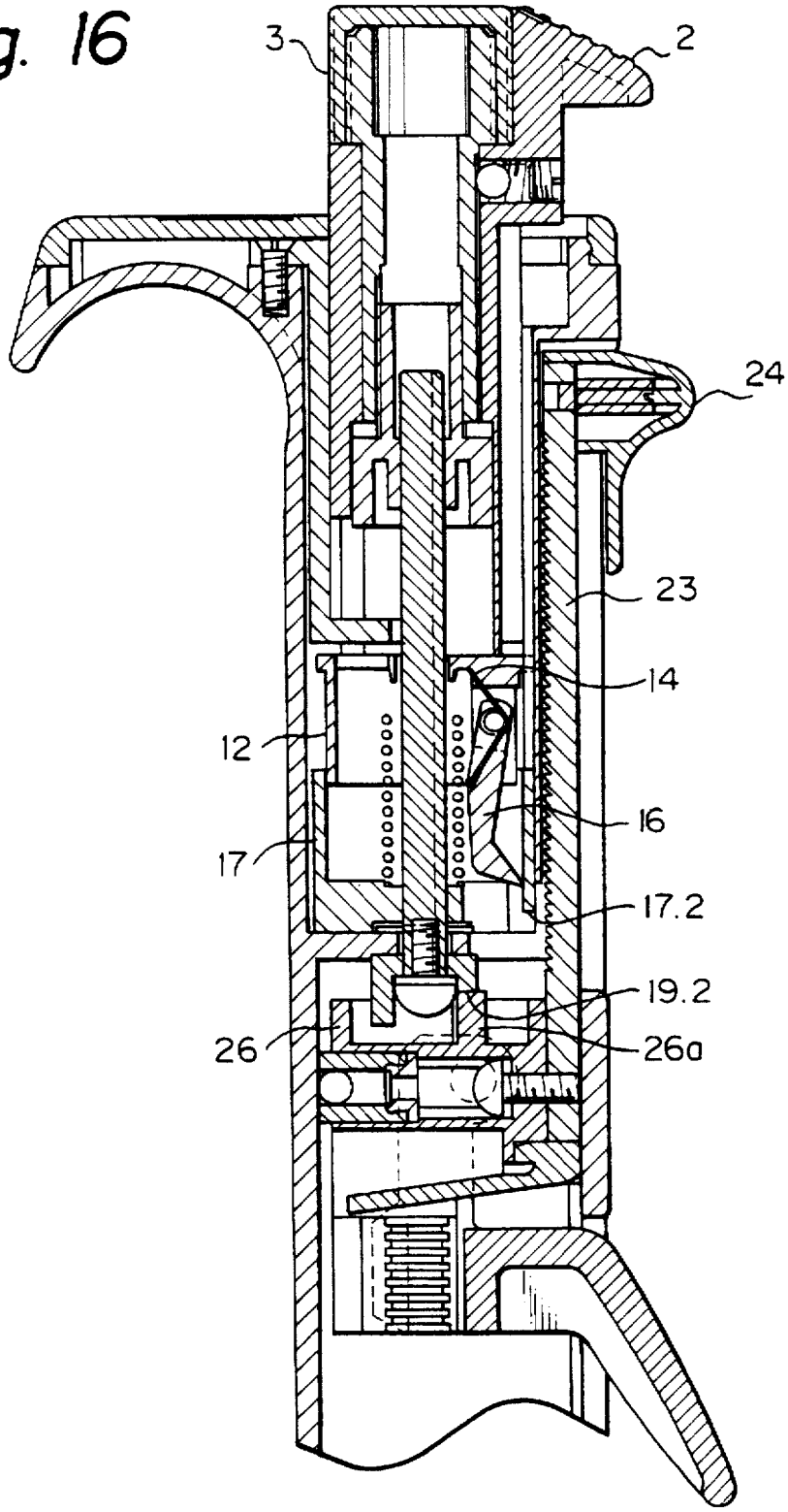
FIG. 16 is an enlarged sectional view illustrating the repetitive pipette shown in FIG. 1 in a state where a liquid has been sucked with the rotary control knob position No. 2 selected.
Figure 17:
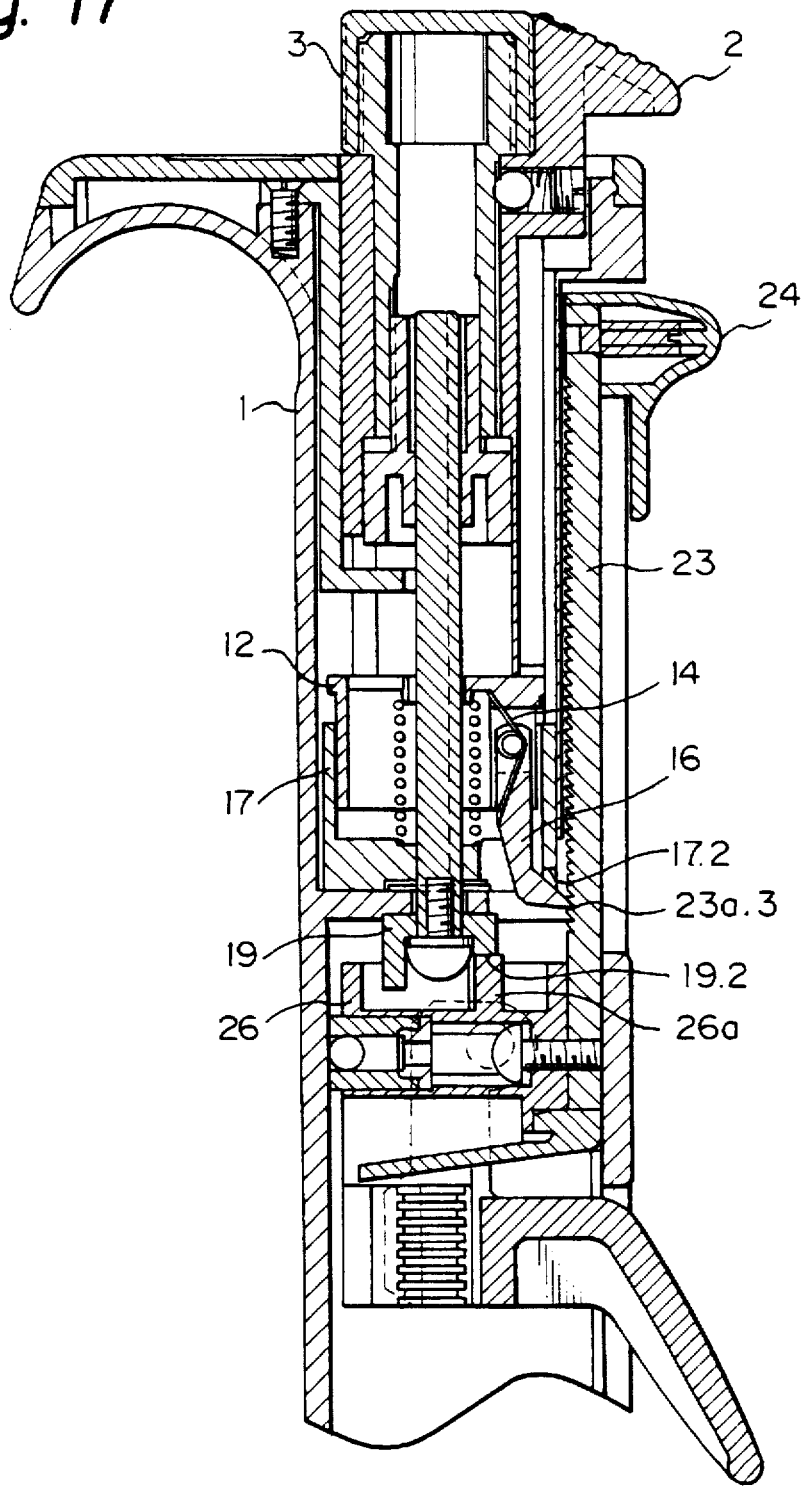
FIG. 17 is an enlarged sectional view illustrating the repetitive pipette shown in FIG. 1 in a state where the pawl has been meshed with the rack shaft after a liquid has been sucked with the rotary control knob position No. 2 selected.

Next, the position No. 2 of the rotary control knob 3 is aligned with the Δ mark 2c, and the suction button 24 is pushed up until the projection-shaped stopper 26a of the holder 26 comes in contact with the cam projection 19.2. In this case, because the cam projection 19.2 projects downward more than the first cam projection 19.1 by 1 mm, as shown in FIG. 16 and part (*b*) of FIG. 20, the lowermost tooth 23a.1 of the rack shaft 23 returns only to a position which is 1 pitch (−1 pitch) below the pawl meshing reference height hO. Accordingly, when the push button 2 is pushed down, the pawl 16 projects outward from the cam recess 17.2 of the rotary cam 17. That is, because the cam recess 17.2 is recessed upward more than the first cam recess 17.1 by +1 mm, the pawl 16 comes out from a position which is +1 mm higher than in the case of the position No. 1, and meshes with the third tooth 23a.3 from the bottom, as shown in FIG. 17 and part (*b*) of FIG. 20. When the push button 2 is subsequently depressed, the rack shaft 23 is pushed down by 2 pitches to the lower limit height h1. When this operation is repeated 24 times in total, the rack shaft 23 moves downward through a distance corresponding to 48 pitches. In this case, the rack shaft 23 moves downward as far as the position shown in FIG. 15 in the same way as in the case of the position No. 1 by virtue of the effect that the remainder (=1) has previously been absorbed by the cam projection 19.2, as described above.

Regarding the positions Nos. 3 and 4, the remainder is similarly absorbed in advance. In the case of the position No. 3, the pawl 16 projects from the cam recess 17.3 (+2 mm) of the rotary cam 17; therefore, as shown in part (*c*) of FIG. 20, the pawl 16 meshes with the fourth tooth 23a.4 from the bottom, and pushes down the rack shaft 23 by 3 pitches at a time. In the case of the position No. 4, the pawl 16 projects from the cam recess 17.4 (+3 mm) of the rotary cam 17; therefore, as shown in part (*d*) of FIG. 20, the pawl 16 meshes with the fifth tooth 23a.5 from the bottom, and pushes down the rack shaft 23 by 4 pitches at a time.

Figure 18:
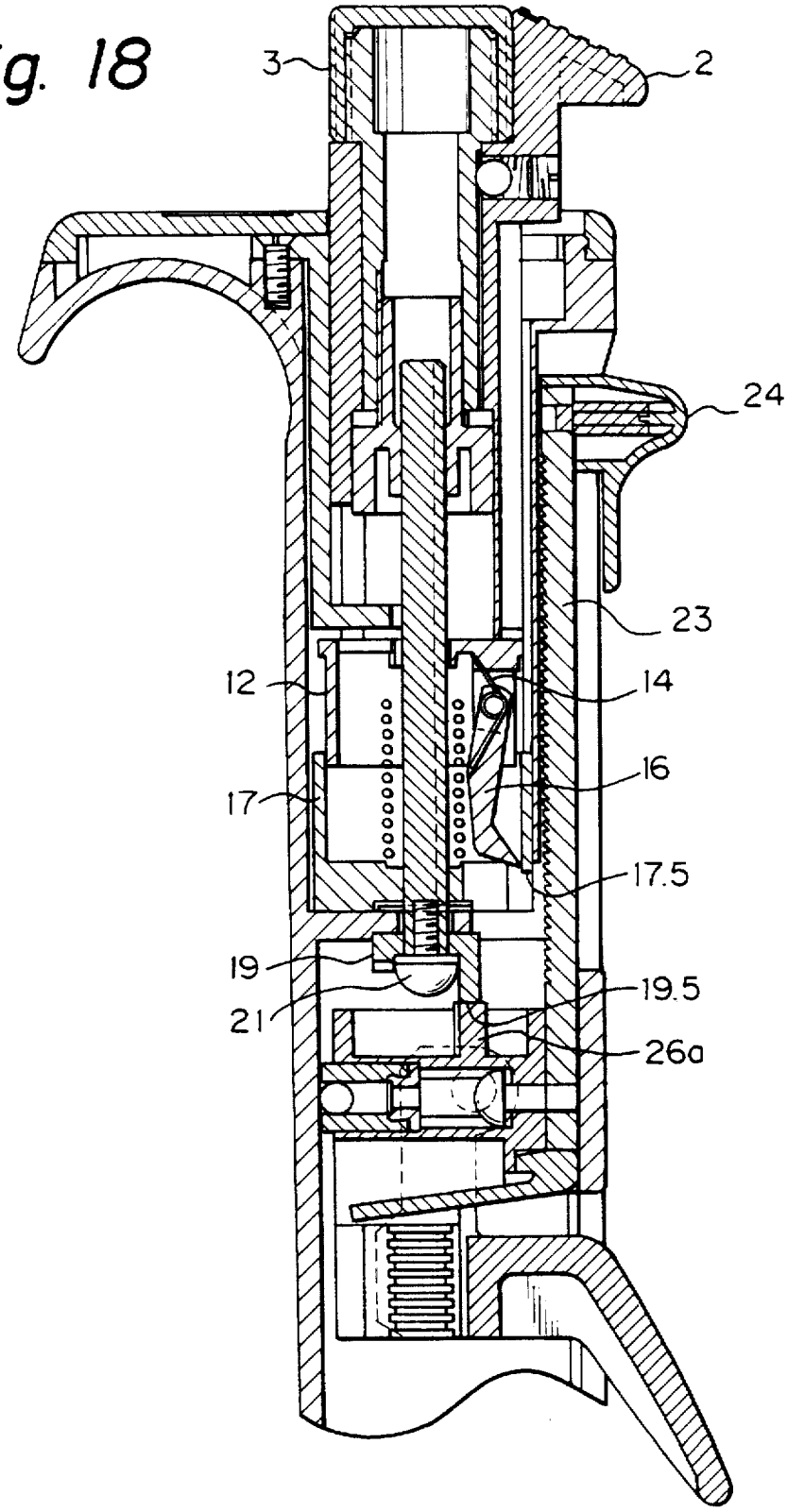
FIG. 18 is an enlarged sectional view illustrating the repetitive pipette shown in FIG. 1 in a state where a liquid has been sucked with the rotary control knob position No. 5 selected.
Figure 19:
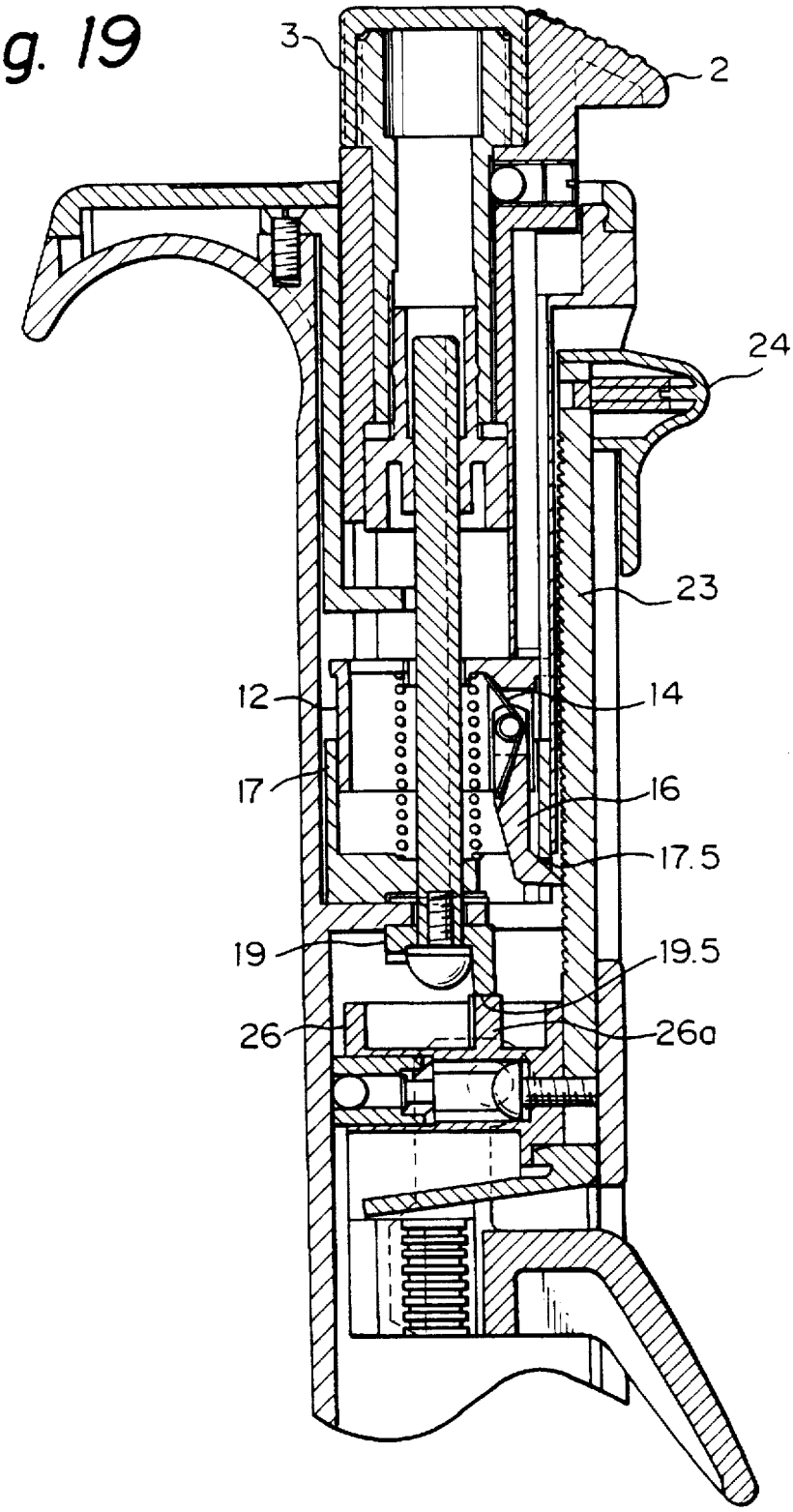
FIG. 19 is an enlarged sectional view illustrating the repetitive pipette shown in FIG. 1 in a state where the pawl has been meshed with the rack shaft after a liquid has been sucked with the rotary control knob position No. 5 selected.
Figure 20:
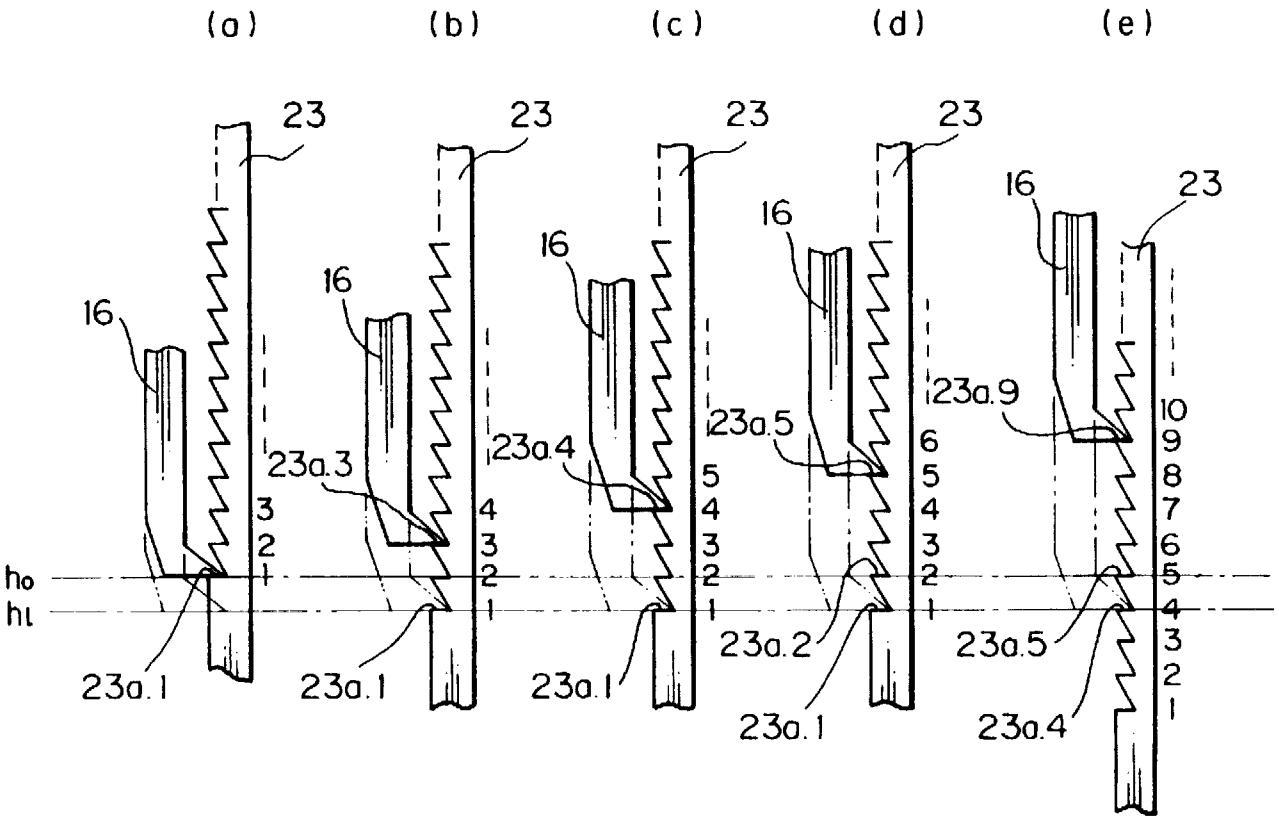
FIG. 20 schematically shows pawl meshing positions corresponding to the rotary control knob positions Nos. 1 to 5 in the repetitive pipette shown in FIG. 1.

In the case of the position No. 5, as shown in FIG. 18 and part (*e*) of FIG. 20, the pawl 16 projects from the cam recess 17.5 (+4 mm) of the rotary cam 17, and meshes with the ninth tooth 23a.9 from the bottom to push down the rack shaft 23 by 5 pitches at a time. It should be noted that, in the case of the positions Nos. 3 to 5 also, the lower limit position of the rack shaft 23 is the same as in the case of FIG. 15.

Table 1 below shows the rotary control knob positions Nos. 1 to 5 and the corresponding recesses and projections of the rotary cam and stopper, together with the suction stroke, the number of tooth pitches by which the rack shaft is fed by a single push-button operation (down-feed pitch), and the number of pipetting operations.

TABLE 1

| Rotary control knob No. | Rotary cam recess | Rotary stopper projection | Suction stroke (number of pitches) | Down-feed pitch | Number of pipetting operations |
|---|---|---|---|---|---|
| 1 | 17.1 | 19.1 | 49 | 1 | 49 |
| 2 | 17.2 | 19.2 | 48 | 2 | 24 |
| 3 | 17.3 | 19.3 | 48 | 3 | 16 |
| 4 | 17.4 | 19.4 | 48 | 4 | 12 |
| 5 | 17.5 | 19.5 | 45 | 5 | 9 |

Pipetted quantities vary according to the volumetric capacity of the syringe unit 41 attached to the pipette. Table 2 below shows examples of syringe units and pipetted quantities (ml). It should be noted that the reason why the number of practical pipetting operations is one smaller than the number of pipetting operation in Table 2 is that in the first pipetting operation carried out at the time of starting pipetting, the sucked liquid is thrown away without being pipetted because it is likely that air or other foreign matter will get mixed in the sucked liquid.

TABLE 2

| Rotary control knob No. Syringe capacity (ml) | 1 | 2 | 3 | 4 | 5 |
|---|---|---|---|---|---|
| | pipetted quantity (ml) | | | | |
| 0.05 | 0.001 | 0.002 | 0.003 | 0.004 | 0.005 |
| 0.5 | 0.01 | 0.02 | 0.03 | 0.04 | 0.05 |
| 1.25 | 0.025 | 0.05 | 0.075 | 0.1 | 0.125 |
| 2.5 | 0.05 | 0.1 | 0.15 | 0.2 | 0.25 |
| 5 | 0.1 | 0.2 | 0.3 | 0.4 | 0.5 |
| 12.5 | 0.25 | 0.5 | 0.75 | 1.0 | 1.25 |
| 25 | 0.5 | 1.0 | 1.5 | 2.0 | 2.5 |
| 50 | 1.0 | 2.0 | 3.0 | 4.0 | 5.0 |
| Number of pipetting operations | 49 | 24 | 16 | 12 | 9 |
| Number of practical pipetting operations | 48 | 23 | 15 | 11 | 8 |

ADVANTAGEOUS EFFECTS OF THE INVENTION

① In the repetitive pipette according to the present invention, the push button 2 and the pipetted quantity variably setting device (3 and 17) are coaxially integrated into one unit. Accordingly, the cylindrical pipette body 1, which accommodates the push button 2 and the pipetted quantity variably setting device (3 and 17), can be formed by an integral molding process, and the total number of constituent elements can be reduced; therefore, it is possible to simplify the arrangement and to facilitate the assembling and disassembling operations in comparison to Japanese Patent Unexamined Publication (KOKAI) Nos. 56-7649 (first type of conventional repetitive pipette) and 6-7688 (second type of conventional repetitive pipette). That is, in these conventional repetitive pipettes, a pivoting lever is disposed on a side of a pipette body and a rack feed pitch varying cam mechanism is disposed in the upper part of the pipette body. Consequently, downward moving mechanisms are separately disposed at two positions, i.e., an axial position and a side position. Accordingly, the arrangement becomes complicated as a whole, and the pipette body must be formed in a two-part structure.

② In the repetitive pipette according to the present invention, the push button 2, together with the pipetted quantity variably setting device (3 and 17), can be disposed at an axial position in the pipette. Accordingly, the rack shaft 23 can be repeatedly fed through a predetermined pitch simply by repeatedly depressing the push button 2 with the thumb while holding the pipette body 1 with the hand. Therefore, during the repetitive operation, the position of the thumb is kept stable on the push button 2, and the operation can be readily performed simply by moving the push button 2 up and down in comparison to the above-described two conventional repetitive pipettes, in which the lever projecting sideward from the pipette body is repeatedly pivoted downward.

③ In the repetitive pipette according to the present invention, the push button 2 and the pipetted quantity variably setting device (3 and 17) are coaxially arranged. Accordingly, the feed pitch of the rack shaft 23 can be changed to variably set a pipetted quantity by only slightly shifting the thumb on the push button 2 in the radial direction while holding the pipette body 1 with the hand, and rotating the rotary control knob 3 with the thumb and the forefinger. Therefore, in contrast to the above-described conventional repetitive pipettes, in which the thumb which has been placed on the lever projecting sideward from the pipette body must be moved through a relatively long distance as far as the top of the pipette body in order to rotate the cam mechanism, the repetitive pipette according to the present invention has no need of changing the way in which the user holds the pipette. Moreover, the travel of the thumb is minimized, and the pipetted quantity varying operation is extremely facilitated. In particular, the controllability is extremely improved because the number of feed pitch varying operations is usually large.

④ The change of the meshing position of the pawl 16 with the rack shaft 23 to variably set a pipetted quantity is effected by allowing the pawl 16 to directly and selectively contact one of a plurality of cam step portions 17.1 to 17.5 of the pawl stroke varying rotary cam 17. Thus, in contrast to the above-described conventional repetitive pipettes, in which the pawl member contacts the rotary cam mechanism indirectly through an intermediate member, the repetitive pipette according to the present invention uses no intermediate member, and the accuracy of the operation increases correspondingly. Accordingly, the reliability can be improved, and the arrangement is simplified through the elimination of the intermediate member.

⑤ In the repetitive pipette having the suction stroke varying device (19 and **26*a*) mentioned as a preferred embodiment of the repetitive pipette according to the present invention, the lower limit position of the rack shaft 23 is accurately kept at a predetermined position at all times irrespective of variations of the feed pitch by previously absorbing variations of the remaining number of teeth of the rack shaft 23 by a plurality of cam step portions 19.1 to 19.5 of the suction stroke varying rotary stopper 19. Accordingly, the lower limit position of the plunger 43 is stably kept at the predetermined position at all times, and accurate pipetting can be performed as far as the final feed pitch in contrast to the above-described conventional repetitive pipettes, in which the spring 41 for the pawl 39 rides over the projection 52 of the rack 14 to cancel mesh of the pawl 39 with the rack teeth [Japanese Patent Unexamined Publication (KOKAI) No. 56-7649], or the spring 17 for the pawl 8 engages in the escape recess 18 of the rack 13 to cancel mesh of the pawl 8 with the rack teeth [Japanese Patent Unexamined Publication (KOKAI) No. 6-7688]. In the conventional repetitive pipettes, it is likely that the pawl mesh canceling position and hence the plunger lower limit position will become unstable owing to erroneous elastic deformation of the spring, which is characteristic thereof. Further, in the present invention the lower limit position of the rack shaft 23 is determined by the cam 19**. Therefore, the accuracy and stability of the operation are higher than in the case of using a spring as in the conventional repetitive pipettes.

What is claimed is:

1. A repetitive pipette wherein a rack shaft vertically and movably provided in a pipette body is connected to a plunger of a syringe unit, and a vertically movable and pivotable pawl member repetitively moves downward and meshes with said rack shaft to feed said plunger downward by a predetermined feed pitch at each time, thereby effecting repetitive pipetting, and wherein said predetermined feed pitch for said rack shaft can be variably set by pipetted quantity variably setting means, said repetitive pipette comprising:

a vertically movable push button provided on said pipette body;

a rotary control knob for variably setting a pipetted quantity, said rotary control knob being provided in coaxial relation to said push button so as to be vertically movable together with said push button as one unit and rotatable relative to said push button;

a pawl retaining member for retaining said pawl member, said pawl retaining member being vertically movable together with said push button as one unit;

a spring for upwardly biasing said pawl retaining member, push button and rotary control knob; and a pawl stroke varying rotary cam having a plurality of first cam step portions for variably setting a position from which said pawl member starts pivoting toward said rack shaft to mesh with it, said pawl stroke varying rotary cam being rotated together with said rotary control knob as one unit to allow one of said first cam step portions to correspond to said pawl member selectively;

said pipetted quantity variably setting means comprising said rotary control knob and said pawl stroke varying rotary cam.

2. A repetitive pipette according to claim 1, wherein said rotary control knob and said pawl stroke varying rotary cam are mounted on a shaft so as to be rotatable together with said shaft as one unit, said shaft being rotatably mounted to said pipette body in an axially fixed position.

3. A repetitive pipette according to claim 1, wherein said push button is provided with a ball which selectively and biasedly engages with one of recesses provided at circumferentially and equally spaced positions on said rotary control knob or a member which rotates together with said rotary control knob as one unit, thereby click-positioning said rotary control knob in a direction of rotation.

4. A repetitive pipette wherein a rack shaft vertically and movably provided in a pipette body is connected to a plunger holder for holding a plunger of a syringe unit, and a vertically movable and pivotable pawl member repetitively moves downward and meshes with said rack shaft to feed said plunger downward by a predetermined feed pitch at each time, thereby effecting repetitive pipetting, and wherein said predetermined feed pitch for said rack shaft can be variably set by pipetted quantity variably setting means, said repetitive pipette comprising:

a vertically movable push button provided on said pipette body;

a rotary control knob for variably setting a pipetted quantity, said rotary control knob being provided in coaxial relation to said push button so as to be vertically movable together with said push button as one unit and rotatable relative to said push button;

a pawl retaining member for retaining said pawl member, said pawl retaining member being vertically movable by being pushed by said push button;

a spring for upwardly biasing said pawl retaining member, push button and rotary control knob;

a pawl stroke varying rotary cam having a plurality of first cam step portions for variably setting a position from which said pawl member starts pivoting toward said rack shaft to mesh with it, said pawl stroke varying rotary cam being rotated together with said rotary control knob as one unit to allow one of said first cam step portions to correspond to said pawl member selectively; and a suction stroke varying rotary cam having a plurality of second cam step portions for variably setting a suction stroke for said plunger in order to settle a remainder of a number of teeth of said rack shaft, said suction stroke varying rotary cam being rotated together with said rotary control knob as one unit to allow one of said second cam step portions to correspond to a stopper portion of said plunger holder selectively;

said pipetted quantity variably setting means comprising said rotary control knob and said pawl stroke varying rotary cam.

5. A repetitive pipette according to claim 4, wherein said rotary control knob, pawl stroke varying rotary cam and suction stroke varying rotary cam are mounted on a shaft so as to be rotatable together with said shaft as one unit, said shaft being rotatably mounted to said pipette body in an axially fixed position.

6. A repetitive pipette according to claim 4, wherein said push button is provided with a ball which selectively and biasedly engages with one of recesses provided at circumferentially and equally spaced positions on said rotary control knob or a member which rotates together with said rotary control knob as one unit, thereby click-positioning said rotary control knob in a direction of rotation.

* * * * *